United States Patent [19]

Gerhard

[11] Patent Number: 4,756,447

[45] Date of Patent: Jul. 12, 1988

[54] TEMPERATURE-CONTROLLED TANK CONTAINER

[75] Inventor: Helmut Gerhard, Weitefeld, Fed. Rep. of Germany

[73] Assignee: Westerwaelder Eisenwerk Gerhard GmbH, Weitefeld, Fed. Rep. of Germany

[21] Appl. No.: 133,337

[22] Filed: Dec. 15, 1987

[30] Foreign Application Priority Data

Dec. 19, 1986 [DE] Fed. Rep. of Germany ..... 3643557

[51] Int. Cl.[4] ..... B65D 25/00

[52] U.S. Cl. ..... 220/469; 220/465; 220/445; 220/5 A; 220/1 B

[58] Field of Search ..... 220/469, 465, 445, 5 A, 220/1 B

[56] References Cited

U.S. PATENT DOCUMENTS

| | | | |
|---|---|---|---|
| 2,882,694 | 4/1959 | Vander Arend et al. | 220/445 X |
| 3,157,147 | 11/1964 | Ludwig | 220/465 X |
| 3,984,994 | 10/1976 | Ehle et al. | 220/465 X |

*Primary Examiner*—Steven M. Pollard

*Attorney, Agent, or Firm*—Barnes & Thornburg

[57] ABSTRACT

A temperature-controlled tank container comprises a heat-insulating jacket (23) surrounding the tank on all sides with a uniform close spacing. The space between the tank and the jacket (23) is subdivided into compartments by reinforcing rings (13), end rings (14), and partition webs (30) which extend on either side of the vertex line. By means of through-holes (37 . . . 42) formed in the reinforcing rings (13) and end rings (14), the compartments communicate with each other so that a temperature-control medium, which is supplied and discharged at one end, flows completely about the tank along a meandering path and through a vertex channel (34) which includes the tank fittings (18).

11 Claims, 4 Drawing Sheets

TEMPERATURE-CONTROLLED TANK CONTAINER

DESCRIPTION

Figure 1:
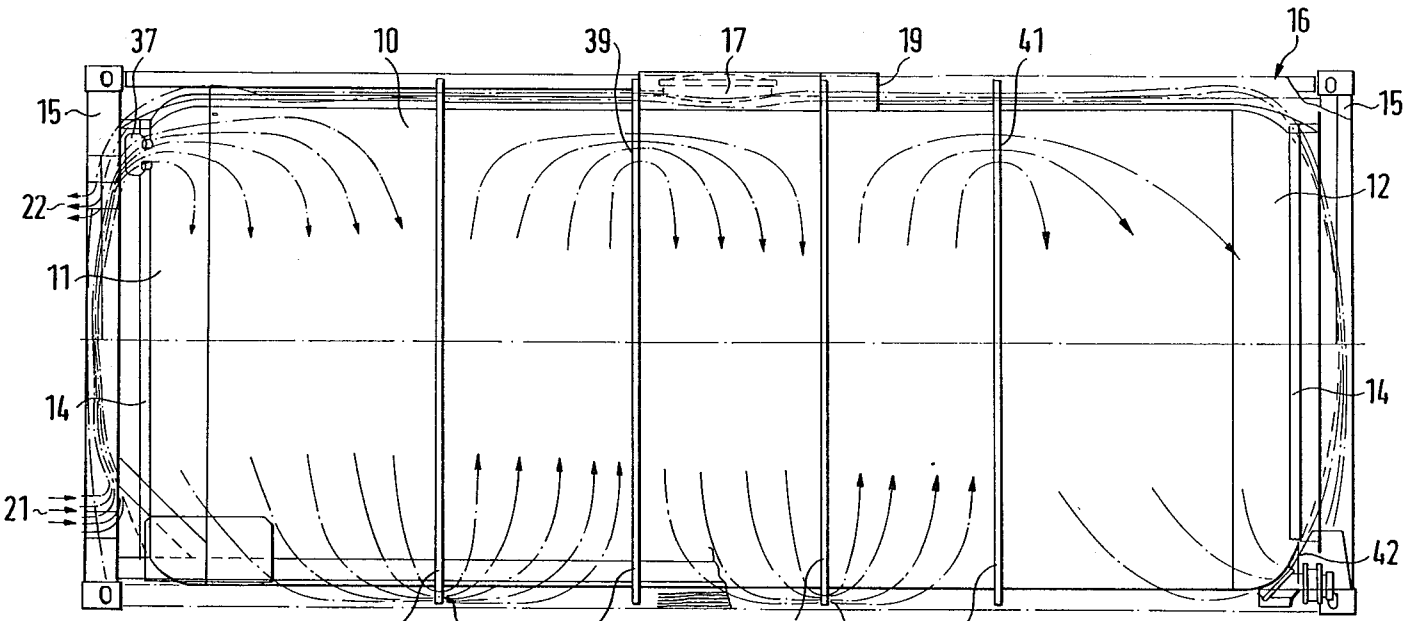

A temperature-controlled tank container is known from DE-C2-2,917,364 which comprises a tank mounted in a container framework, the tank casing including a cylindrical shell with tank fittings provided at the vertex thereof and two bottom members, a heat-insulating jacket enclosing the tank on all sides and having two portholes formed at one of its ends for admitting and discharging a temperature-control medium, and partitions disposed between the tank and the jacket in such a manner that the temperature-control medium is forced to flow around the entire tank.

It is emphasized as an important feature in said publication that the heat-insulating jacket is mounted on the planar wall surfaces of a cuboid container framework. Large triangular flow areas are formed between these planar wall surfaces and the cylindrical tank. Consequently a major part of the temperature-control medium can flow without contacting the tank, all the more as through-holes for the passage of the temperature-control medium are provided rather far away from the tank in transverse bulkheads.

Furthermore, in the known tank container the space between the tank and the heat-insulating jacket is subdivided by partitions in such a way that the temperature-control medium flows almost exclusively in the axial direction of the tank, so that a laminar flow may develop over large distances. Depending on the arrangement of the partitions, a flow path length is obtained which is no more than two to four times the length of the tank.

These circumstances limit the degree to which the temperature-control medium is utilized for cooling or heating the tank.

Apart from that, because the heat-insulating jacket is disposed along the planar surfaces of the container framework, it requires a considerable amount of insulating and covering material, and this results in a corresponding increase in the tare mass of the entire tank container.

It is known form DE-U1-7,120,959 to arrange a heat-insulating jacket between rings extending in different radial planes and in concentric relation to the tank, and to make a temperature-control medium flow through the thus formed space. Also there, however, the overall flow of medium around the tank is insufficient.

It is an object of the present invention to provide a temperature-controlled tank container which permits a uniform flow around the entire tank including the tank fittings while optimally utilizing the temperature-control medium.

To meet with this object, the invention provides a tank container which comprises a tank mounted in a container framework, the tank casing including a cylindrical shell with tank fittings provided at the vertex thereof and two bottom members, a heat-insulating jacket surrounding the tank casing on all sides with a spacing therebetween which is substantially constant througout, and having two portholes formed at one of its ends for admitting and discharging a temperature-control medium, and partitions disposed between the tank casing and the jacket and comprising a plurality of partition rings surrounding the tank casing in radial planes and two partition webs extending in parallel on either side of a vertex line of the tank, the partition rings and webs, by way of through-holes formed in said partition rings, defining compartments which communicate with each other in such a manner that the temperature-control medium flows in one direction along the entire length of the tank through a vertex channel surrounding the tank fittings and in the other direction along a meandering path which passes over all remaining areas of the tank casing.

The temperature-control medium is thus passed as a layer of substantially uniform overall thickness, which in practice amounts to but a few centimeters in intimate contact with the tank. The uniform small distance between the insulating jacket and the tank and the meandering configuration of the flow path also cause continuous turbulences in the temperature-control medium, so that the entire mass of the medium is utilized for effective heat exchange along the tank surface. Due to the fact that the tank is closely surrounded, less insulating and covering material is required for the insulating jacket, whereby the overall weight of the tank container is reduced.

In a preferred embodiment, the invention is applied to a tank which is supported merely via end rings by the end parts of a container framework, and these end rings are used for further subdividing the space between the tank and the insulating jacket. In this arrangement, it is advantageous to incorporate the vertex channel in the overall flow system, and to provide an overflow sump surrounding the tank fittings in the flow path of the temperature-control medium in such a manner that no overflow reaches this flow path. In a further development of the invention, the partition webs forming the vertex channel may simultaneously be used to tighten the insulating jacket or the inside skin thereof.

Additional measures may be provided to reinforce the overall structure and to ensure sufficiently large flow cross-sections for the passage of the temperature-control medium while at the same time confining the flow of the medium in the circumferential direction.

Further or alternative features of the invention intend to achieve the necessary distance between the outer and inner skins of the insulating jacket and also to support the jacket on the tank casing.

Figure 2:
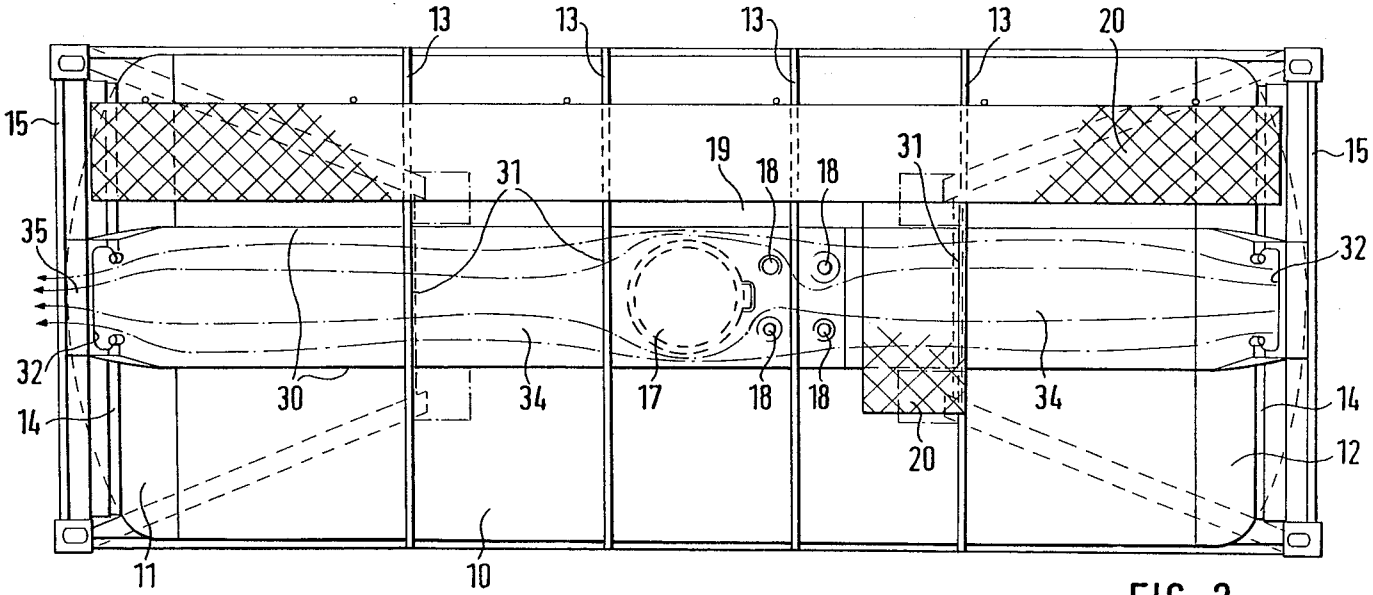
Figure 3:
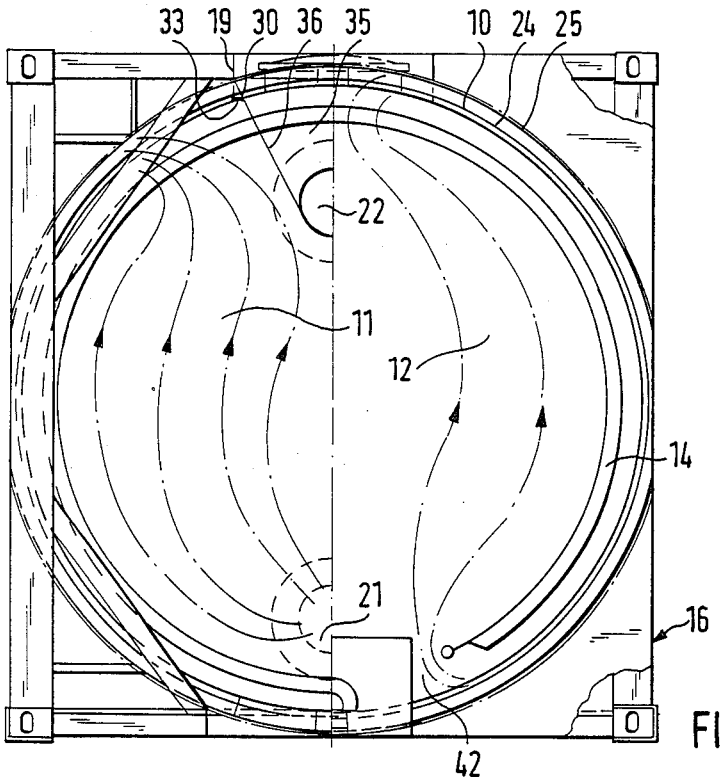
Figure 4:
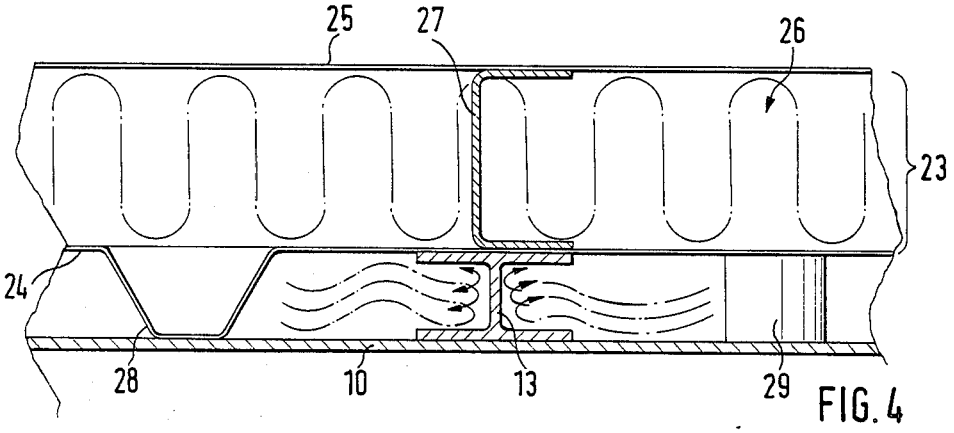
Figure 5:
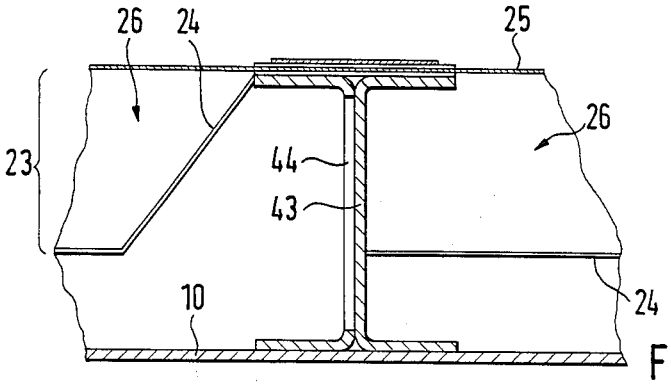
Figure 6:
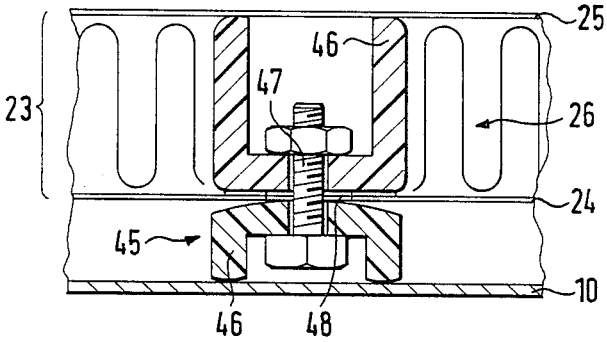
Figure 7:
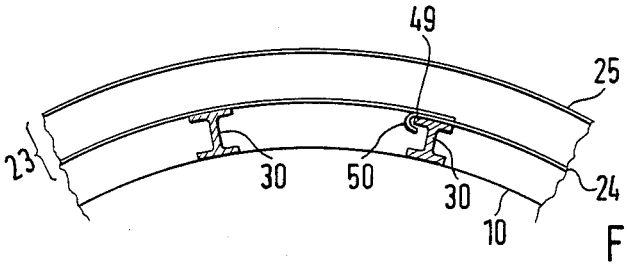

Advantageous embodiments of the invention will now be described in detail below with reference to the drawings, in which FIG. 1 is a schematic side view of a temperature-controlled tank container, FIG. 2 is a plan view showing the tank container of FIG. 1, FIG. 3 is an end view of the tank container of FIGS. 1 and 2, FIG. 4 is an axial section through a part of the tank and the heat-insulating jacket, FIG. 5 is an axial section similar to FIG. 4 through another embodiment of the insulating jacket and its mounting on the tank, FIG. 6 is a further axial section similar to FIG. 4 which illustrates another space member inserted between the tank and the inner and outer skins of the insulating jacket, and FIG. 7 is a detail which shows a way of mounting of the inner skin of the insulating jacket.

As will be apparent from FIGS. 1 and 2, the tank is composed of a cylindrical shell 10 and bottom members 11, 12 affixed to the two ends thereof, the shell 10 being surrounded by a plurality of reinforcing rings 13 spaced in the axial direction. The bottom members 11, 12 are mounted through end rings 14 on end members 15 of an outer container framework 16 which has a cuboid outline. Such a way of mounting a tank merely by its ends in a framework is known from U.S. Pat. No. 4,593,832. At the top, the shell 10 is provided with a manhole 17 and tank fittings 18 which are disposed in an overflow sump 19. Walkways are indicated at 20 in FIG. 2.

The left-hand part of FIG. 3 is an end view of the tank container of FIGS. 1 and 2 as seen from the left including the bottom member 11, while the right-hand part is a view of the right-hand end as seen in FIGS. 1 and 2 including the bottom member 12. The bottom member 11 is formed with two holes 21, 22 for connection to a temperature-control medium supply system. Such supply systems are especially common in container ships, and the temperature-control medium is normally cooling air which is available at large rates of flow but small differential pressure. In such a cooling system, the holes 21, 22 are also called "portholes", of which the lower one 21 is an inlet porthole and the upper one 22 is an outlet porthole. The flow of the cooling medium is caused by negative pressure acting on the outlet porthole 22.

The axial section of FIG. 4 illustrates a double-T-section reinforcing ring 13 mounted on the tank shell 10 which form the cylindrical part of the tank casing. The outer flange of the reinforcing ring 13 supports a heat-insulating jacket generally referenced 23 and comprising an inner skin 24, an outer skin 25 and insulating material 26 disposed therebetween. The outer skin 25 is supported through a C-section spacer ring 27 which is disposed in the same radial plane as the reinforcing ring 13 and rests on the latter through the intermediate of the inner skin 24. In the regions between the reinforcing rings 13, the inner skin 24 is supported by means of individual corrugations 28 and/or inserted spacer members 29.

The space formed between the tank shall 10 and the inner skin 24 of the insulating jacket 23, which has a height of but a few centimeters as defined by the height of the web of the reinforcing rings 13, is subdivided according to FIG. 2 on either side of the upper vertex line by means of partition webs 30 the mutual spacing of which is approximately equal to the width of the overflow sump 19 as measured in the circumferential direction.

These partition webs 30 extend at either end of the tank shell 10 into the region between the tank bottom members 11, 12 and the inner skin 24 of the insulating jacket 23 to terminate at the end rings 14. In the region between the two partition webs 30, the reinforcing rings 13 are provided with through-holes 32. In this way, a vertex channel 34 is formed along the vertex line of the tank between the tank casing and the insulating jacket, said vertex channel extending in the axial direction from one bottom area to the other. As indicated in FIG. 3, the horizontal bottom parts 33 of the overflow sump 19 are provided outside of, and therefore beneath, those locations where the partition webs 30 engage the end walls of the overflow sump 19. Thus, liquid accumulating in the overflow sump is prevented from entering the vertex channel 34.

In the vicinity of the left-hand end, as viewed in FIGS. 1 and 2, the vertex channel 34 continues into a wedgeshaped compartment 35 defined by two webs 36 which are inserted between the inner skin 24 of the jacket 23 and the tank bottom member 11 and which converge at an angle and enclose the outlet porthole 22. (FIG. 3 shows only one of said webs 36). Through this wedge-shaped compartment 35, the vertex channel 34 opens into the outlet porthole 22, which passes through the jacket 23 and is provided with a collar (not illustrated) for connection to a cooling system, for instance of a container ship.

Outside the vertex channel 34, the end rings 14 and the reinforcing rings 13 are formed with further through-holes 37 . . . 42 alternatingly provided in the vicinity of the vertex channel (in the circumferential direction on either side thereof) and in the lower bottom area. As shown in FIG. 1, the through-hole 37 in the left-hand end ring 14 and the through-holes 39 and 41 in the reinforcing rings 13 are disposed near the vertex channel 34, while the through-holes 38 and 40 in the reinforcing rings 13 and the through-hole 42 (also indicated in FIG. 3) in the right-hand end ring 14 are disposed in the vicinity of the tank bottom. As will be apparent from FIG. 3, the space formed outside the wedge-shaped compartment 35 and defined by the tank bottom member 11 and the inner skin 24 of the jacket 23 communicates with the lower inlet porthole 21 which, like the outlet porthole 22, passes through the jacket and is provided on the outside thereof with a collar (not illustrated) for connection to the cooling system.

The compartments defined by the various partitions, i.e. the reinforcing rings 13, the end rings 14 and the partition webs 30 and 36, between the tank casing and the insulating jacket are intercommunicated via the through-holes 30 to 32 and 37 to 42 in such a way that the cooling medium entering through the inlet porthole 21 flows initially upwards along the left-hand container bottom (as viewed in FIG. 1), passes the through-hole 37 and flows downwardly in the region between the end ring 14 and the first reinforcing ring 13, passes the through-hole 38 to flow upwardly through the next compartment defined between the two successive reinforcing rings 13, then flows downwards, upwards, and again downwards to pass the through-hole 42 in the right-hand end ring 14, then upwards along the right-hand tank bottom member 12, through the right-hand through-hole 32 (as viewed in FIG. 2) formed in the end ring 14 into the vertex channel 34, where it flows leftwards in the axial direction through the overflow sump 19 while surrounding the tank fittings 18 and the manhole 17, and finally flows through the left-hand through-hole 32 (as viewed in FIG. 2) of the end ring 14 and through the wedge-shaped compartment 35 to the outlet porthole 22.

Between the inlet porthole 21 and the bottom-side through-hole 42 in the right-hand end ring 14, the cooling medium flow is distributed to the two regions provided to the right and left of the vertical longitudinal plane of the tank, and in each of said regions flows along a meander-like path indicated by arrows in FIGS. 1.

The way of mounting the insulating jacket 23 illustrated in FIG. 5 differs from that of FIG. 4 in that the reinforcing ring 13 and the spacer ring 27 of FIG. 4 have been combined to form an integral, double-T-section ring 43 which is used as a reinforcing ring for the tank casing. In FIG. 5, this ring 43 is shown as composed of two C-section rings which have been preformed with holes and placed back-to-back. In this case, a through-hole 44 for the temperature-control medium (which is illustrated only as a semi-through-hole) may extend across the entire web height and may therefore be limited to a narrower region in the circumferential direction while the cross-section remains the same. This offers the advantage that all of the temperature-control medium is forced to flow as far as possible in the circumferential direction in each compartment defined between two reinforcing rings. In order to use the entire web height for the through-hole 44, the inner skin 24 of the insulating jacket 23 is bent outwards and secured to the outer leg of the ring 43, as illustrated in the left-hand part of FIG. 5, whereas other parts thereof are secured to an intermediate portion of the web of the ring 43, as illustrated in the right-hand part of FIG. 5.

FIG. 6 illustrates a further modification of a spacer member 45 by means of which the outer skin 25 and the inner skin 24 of the jacket 23 can be held in spaced relationship with respect to each other and to the tank shell 10. This spacer member 45 consists of two cup-shaped insulating bodies 46, which may be made from rigid polyurethane foam, wood, or polyethylene, and the bottoms of which engage the inner skin 24 while their edges engage the tank shell 10 and the outer skin 25, respectively. A common bolt 47 is passed through the two cup bottoms and an opening 48 formed in the inner skin 24, which opening may have a substantially larger dimension than the bolt diameter. The two heads of the bolt 47 (such as bolt head and nut) are sunk in the two cup shapes so as not to contact either the tank shell or the outer skin 25. Cup edge and cup bottom of both insulating bodies 46 are crowned so that the cylindrical shape of the tank and the inner and outer skins of the jacket is not disturbed by edges or by the formation of folds.

On assembly, the spacer members 45 can initially be fixed to the inner skin 24, when the two insulating bodies 46 are tightened against each other by means of the bolt 47. The thus equipped inner skin is then stretched around the tank casing, wherein the edges of the radially inner insulating bodies 46 may be fixed to the tank casing such as by an adhesive. Relieving movements of the inner skin 24 are permitted by the play between the bolt 47 and the opening 48. Following the application of the insulating material 26, which may be polyurethane foam, the outer skin 25 is stretched across the outer insulating bodies 46.

When these spacer members 45 are employed, the spacer rings 27 illustrated in FIG. 4 may be dispensed with.

As shown in the detailed illustration of FIG. 7, the partition webs 30 defining the vertex channel 34 have flanges 49 at their upper ends. When the inner skin 24 of the jacket 23 is stretched over the tank it can be hooked to one of these flanges 49 by means of crimped portions 50. In this case the webs 30 may either extend radially, as assumed in FIG. 7, or vertically.

I claim:

1. A temperature-controlled tank container comprising a tank mounted in a container framework, the casing of said tank consisting of a cylindrical shell with tank fittings provided at the vertex thereof and two bottom members, a heat-insulating jacket surrounding the tank casing on all sides with a spacing therebetween which is substantially constant throughout, and having two portholes formed at one end thereof on top of each other for the entry and exit of a temperature-control medium, and partitions disposed between the tank casing and the insulating jacket and comprising a plurality of partition rings surrounding the tank casing in radial planes and two partition webs extending in parallel on either side of a vertex line of the tank, said partition rings and webs, by way of through-holes formed in said partition rings, defining compartments which communicate with each other such that the temperature-control medium flows in one direction along the entire length of the tank through a vertex channel surrounding the tank fittings and in the other direction along a meandering path which passes over all remaining area of the tank casing.

2. The container of claim 1, wherein the tank is connected to end members of the container framework by means of end rings attached to the two bottom members thereof, said end rings defining further partitions for extending the flow path.

3. The container of claim 2, wherein the vertex channel interconnects through-holes formed in the two end rings and at one end terminates in a wedge-shaped compartment which encloses the upper one of said portholes.

4. The container of claim 1, wherein an overflow sump surrounding the tank fittings is incorporated in the vertex channel the horizontal bottom parts of the sump being disposed beneath those positions where the partition webs defining the vertex channel are attached to the sump.

5. The container of claim 1, wherein one of the two partition webs defining the vertex channel is formed with a tangentially extending upper flange for engagement by the insulating jacket.

6. The container of claim 1, wherein the insulating jacket comprises an inner skin, an outer skin and insulating material disposed therebetween, the outer skin being supported relative to the inner skin by means of spacer rings which are disposed in the same radial planes as the partition rings.

7. The container of claim 6, wherein the inner skin is provided with corrugations defining spacer members relative to the tank casing.

8. The container of claim 6, wherein the partition and spacer rings are configured as integral rings, the inner skin of the insulating jacket being attached to the side faces of said integral rings.

9. The container of claim 8, wherein through-holes extend substantially across the full height of the integral ring, the inner skin of the insulating jacket being outwardly deformed in the region of said through-holes.

10. The container of claim 1, wherein the insulating jacket comprises an inner skin, an outer skin and insulating material disposed therebetween, and wherein spacer members are provided each of which includes two cup-shaped insulating bodies having their bottoms placed on the inner skin and their edges engaging the tank casing and the outer skin, respectively, said insulating bodies being tightened against each other by means of a common connecting element extending through a hole in the inner skin.

11. The container of claim 10, wherein the radially inner insulating body is fixed to the tank casing and the connecting element extends with clearance through the hole in the inner skin.

* * * * *